US009816787B2

(12) United States Patent
Keeney

(10) Patent No.: US 9,816,787 B2
(45) **Date of Patent: *Nov. 14, 2017**

(54) REAR SIGHT BLOCK FOR AK-TYPE RIFLES

(71) Applicant: OCCAM DEFENSE SOLUTIONS INC., Moscow, ID (US)

(72) Inventor: Brian Keeney, Moscow, ID (US)

(73) Assignee: Occam Defense Solutions Inc., Moscow, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/594,522

(22) Filed: May 12, 2017

(65) Prior Publication Data

US 2017/0248390 A1 Aug. 31, 2017

Related U.S. Application Data

(63) Continuation of application No. 15/147,000, filed on May 5, 2016, now Pat. No. 9,696,118.

(60) Provisional application No. 62/185,626, filed on Jun. 28, 2015.

(51) Int. Cl.
*F41G 1/10* (2006.01)
*F41G 11/00* (2006.01)

(52) U.S. Cl.
CPC ..... *F41G 11/003* (2013.01); *F41G 1/10* (2013.01)

(58) Field of Classification Search
CPC . F41G 11/003; F41G 1/06; F41G 1/10; F41G 1/387
USPC ..... 42/90, 124, 125, 127
See application file for complete search history.

(56) References Cited

U.S. PATENT DOCUMENTS 873,535 A * 12/1907 Garrison et al. ..... F41G 1/473 42/111
898,178 A * 9/1908 Bourne ..... F41G 1/473 42/111
2,295,791 A 9/1942 Hornback
5,590,484 A 1/1997 Mooney et al.
(Continued)

OTHER PUBLICATIONS quarterbore.net Forums, Polish WZ89 Onyks parts kit—Another addition to my Polish Collection! [online], [dated Nov. 8, 2005], [retrieved on Jul. 29, 2016], Retrieved from the internet <URL: http://www.quarterbore.net/forums/showthread.php?t=603>.
(Continued)

*Primary Examiner* — Reginald Tillman, Jr.
(74) *Attorney, Agent, or Firm* — Asgaard Patent Services, LLC; F. Wayne Thompson, Jr.

(57) ABSTRACT

Implementations of a rear sight block for AK-type rifles are provided. In some implementations, the rear sight block may comprise an optic mounting interface and a sleeve. In some implementations, the optic mounting interface may be used to attach an optical gun sight to the rear sight block, and the sleeve may be used to secure the rear sight block to the barrel of an AK-type rifle. In some implementations, the optic mounting interface may include a rear sight notch therein. In some implementations, the rear sight block may further comprise at least one accessory mounting interface thereon. In some implementations, the accessory mounting interface may be used to position a flashlight, laser, and/or other firearm accessory on the left (or right) side of the rear sight block.

18 Claims, 3 Drawing Sheets

(56) References Cited

U.S. PATENT DOCUMENTS

| | | | | |
|---|---|---|---|---|
| 6,381,895 | B1 * | 5/2002 | Keeney | F41G 11/003 42/111 |
| 6,421,946 | B1 * | 7/2002 | LoRocco | F41G 1/16 42/111 |
| 7,685,758 | B2 | 3/2010 | Romer | |
| 9,068,801 | B1 | 6/2015 | Stecher, Jr. et al. | |
| 9,696,118 | B2 * | 7/2017 | Keeney | F41G 11/003 |
| 2009/0064562 | A1 * | 3/2009 | Casas Salva | F41G 11/003 42/124 |
| 2012/0102803 | A1 * | 5/2012 | Troy | F41C 23/16 42/71.01 |
| 2013/0219766 | A1 | 8/2013 | Lee | |

OTHER PUBLICATIONS

Leszek Erenfeicht and Lt. Col. Dr. Miroslaw Zahor, A Tantalean Ordeal [online], ForgottenWeapons.com, [dated Sep. 13, 2013], [retrieved on Jul. 29, 2016], Retrieved from the internet <URL: http://www.forgottenweapons.com/rifles/wz-88-tantal/>.

Przemyslaw Konicki, Beryl wz. 96 [online], http://www.opisybroni.republika.pl/, [retrieved on Jul. 29, 2016], Retrieved from the internet <URL: http://www.opisybroni.republika.pl/Beryl_eng.html>.

The AK Files, Occam Defense Request for Loaner Rear Sight Blocks [online], [dated Sep. 29, 2017], [retrieved on Oct. 13, 2017], Retrieved from the internet <URL:http://www.akfiles.com/forums/showthread.php?t=321676>; and <URL:http://www.akfiles.com/forums/showthread.php?t=321676&p.=2>.

Gunco, A Better AK Sight [online], [dated Feb. 20, 2013], [retrieved on Oct. 15, 2017], Retrieved from the internet <URL: http://www.gunco.net/forums/43-ak-biy-forum/71469-better-ak-sight.html#post864618>.

The AK Files, "Accurizing the AK"—thoughts, ideas, or go-home-you're-drunk? [online], [dated Aug. 3, 2015], [retrieved on Oct. 15, 2017], Retrieved from the intemet <URL:http://www.akfiles.com/forums/showthread.php?t=231416>; <URL:http://www.akfiles.com/forums/showthread.php?t=231416&page=2>; and <URL:http://www.akfiles.com/forums/showthread.php?t=231416&page=3>.

Gunco, Veper Hunter Cantalever Mount. [online], [dated Nov. 21, 2012], [retrieved on Oct. 15, 2017], Retrieved from the internet <URL:http://www.gunco.net/forums/3-ak-47-discussion-forum/69640-veper-hunter-cantalever-mount.html>.

Gunco, Latest Cantilever Mount Design [online], [dated Mar. 1, 2013], [retrieved on Oct. 15, 2017], Retrieved from the internet <URL:http://www.gunco.net/forums/43-ak-biy-forum/71755-latest-cantilever-mount-design.html>.

Gunco, Polish Beryl "Archer" 5.56 are in US Now !! [online], [dated Jul. 5, 2012], [retrieved on Oct. 15, 2017], Retrieved from the internet <URL:http://www.gunco.net/forums/3-ak-47-discussion-forum/67187-polish-beryl-archer-5-56-us-now-4.html>.

Gunco, 10 Year Olds Hunting AK. [online], [dated Nov. 6, 2010], [retrieved on Oct. 15, 2017], Retrieved from the internet <URL:http://www.gunco.net/forums/50-your-completed-ak-projects/58269-10-year-olds-hunting-ak.html>; and <URL:http://www.gunco.net/forums/50-your-completed-ak-projects/58269-10-year-olds-hunting-ak-2.html>.

The AK Files, wz.89 Onyks RSB repro [online], [dated Jun. 12, 2016], [retrieved on Oct. 15, 2017], Retrieved from the internet <URL: http://www.akfiles.com/forums/showthread.php?p=3316031>.

* cited by examiner

REAR SIGHT BLOCK FOR AK-TYPE RIFLES

CROSS REFERENCE TO RELATED APPLICATION

This application claims the benefit of U.S. application Ser. No. 15/147,000, which was filed on May 5, 2016, which claims the benefit of U.S. Provisional Application Ser. No. 62/185,626, which was filed on Jun. 28, 2015, both applications are incorporated herein by reference in their entirety.

TECHNICAL FIELD

This disclosure relates to implementations of a rear sight block for AK-type rifles having an integral mounting interface for an optical gun sight thereon. Further, in some implementations, the rear sight block may include one or more accessory mounting interfaces thereon.

BACKGROUND

There have been many attempts to improve on the iron sights commonly found on Kalashnikov or AK-type rifles (AK-47, AKM, AK-74, Galil, Tan Tal, Saiga, etc.). When the AK-47 was first introduced more than 75 years ago, optical gun sights (e.g., telescopic sights) were uncommon and expensive. In the modern era, the mounting of optical gun sights (e.g., reflex sights and/or telescopic sights) on both sporting and martial variants of the Kalashnikov is ubiquitous.

However, all of the available optical gun sight mounting options for the AK suffer from various shortcomings. Most of the optical gun sight mounts available are unable to hold the optic in the same place over time, resulting in the point of aim drifting significantly from the point of impact. Many of the optical gun sight mounts are heavy, often adding significant weight near the forend of the rifle thereby making the additional weight feel heavier than it is through leverage. Very few of the available optical gun sight mounts are available on off-the-shelf rifles, forcing the owner to procure and install an expensive part in order to facilitate the mounting of an optical gun sight on the rifle.

One optical gun sight (or optic) mounting solution is the UltiMAK rail (U.S. Pat. No. 6,381,895). It is an aftermarket replacement for an AK-type rifles gas tube which shields the piston that cycles the action upon firing. It is relatively light, securely mounts to the barrel (thereby holding the optic securely in place), and provides a MIL-STD-1913 rail (also known as the Picatinny rail). Once mounted, it's a simple matter to attach an optic thereon and, with other expensive mounting brackets, a flashlight.

However, the UltiMAK rail has several disadvantages. First, if you want to remove the lower hand guard, you have to remove the UltiMAK rail thereby removing the reference that the optical gun sight was previously calibrated to. It is then necessary to re-calibrate the optical gun sight to the rifle (called re-zeroing). Second, the location of the UltiMAK rail, being positioned over the barrel near the gas block, is a significant disadvantage if the optical gun sight mounted thereon has any appreciable mass. This is because the rifle acts as a lever, pulling down on the users arms with more force the farther the optical gun sight is away from the rear of the rifle. Third, the UltiMAK rail sits very low on the rifle making it possible to see both the iron sights and the reticule of the optical gun sight in one sight picture (also known as co-witnessing). By co-witnessing the two sights, the iron sights of the host rifle obstruct the operator's field of view through the lower half of the optic. This could result in the operator making an incorrect shoot or no-shoot decision. Therefore, it could be argued that positioning an optical gun sight on a rifle so that the field of view therethrough is unobstructed is a better option in a dynamic shooting environment. Fourth, securing a flashlight to the UltiMAK is expensive and requires the purchase of an additional bracket. When secured to the rifle, the flashlight makes the rifle heavier than is necessary due to its forward location on the rifle.

It is generally agreed upon in today's martial gun handling schools that a fighting rifle should have both an optic (e.g., reflex type sight and/or telescopic sight) and a flashlight mounted on it. The use of an optic has been shown to decrease target acquisition time and the flashlight is essential for distinguishing threats (e.g., a burglar) from innocent bystanders (e.g., family members) in low light conditions (e.g., in a dark house).

Therefore, there is a persistent need in the market for a rugged, simple, and inexpensive mount that can be used to securely attach an optic and/or flashlight to an AK-type rifle in an ergonomic position.

SUMMARY OF THE INVENTION

Implementations of a rear sight block for AK-type rifles are provided. In some implementations, the rear sight block may be drop-in-compatible with most AK-type rifles and perform several functions (e.g., providing a guide hole for the piston of an AK-type rifles operating system) associated with prior art rear sight blocks found on AK-type rifles. In some implementations, the rear sight block comprises an optic mounting interface having an integral rear sight notch therein, and at least one accessory mounting interface. In some implementations, the optic mounting interface places an optical gun sight secured thereto in line with the iron sights of the host AK-type rifle. In some implementations, the accessory mounting interface may be used to position a flashlight, laser, and/or other firearm accessory on the left (or right) side of the rear sight block. In some implementations, the rear sight block is mounted at or near the rifle's approximate center of mass. In this way, the weight of an optic, and/or other firearm accessory (e.g., a flashlight and/or laser), secured to the rear sight block is unlikely to change the balance or "feel" of the rifle when handled by an operator.

DETAILED DESCRIPTION

Figure 1:
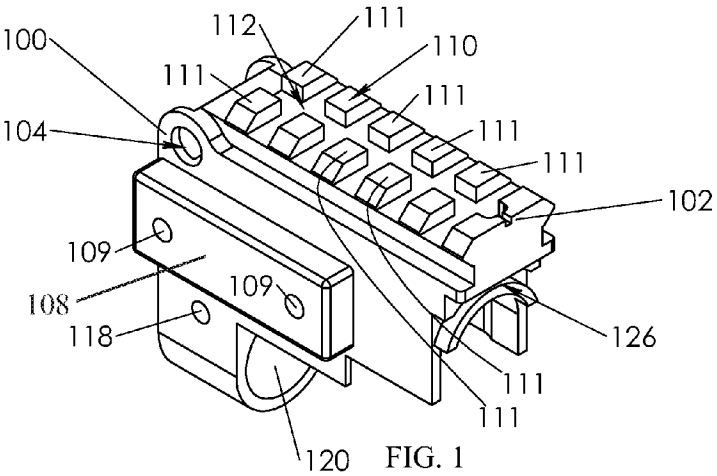
FIG. 1 illustrates an isometric view of the rear sight block for AK-type rifles according to the principles of the present disclosure.

In general, the rear sight block 100 for AK-type rifles disclosed herein is a rugged, simple, and inexpensive mount that may be used to securely attach and ergonomically position an optic and/or a firearm accessory (e.g., a flashlight and/or laser) on an AK-type rifle. In this way, the rear sight block 100 may be superior to prior art rear sight blocks found on AK-type rifles.

FIGS. 1-8 illustrate a preferred implementation of the rear sight block 100 for AK-type rifles according to the principles of the present disclosure. As an initial matter, the rear sight block 100 performs several functions associated with prior art rear sight blocks found on AK-type rifles, including providing a rear sight notch 102, a cam lock hole 104, a guide hole 106 for the piston, and a curved slot 126 which serves as the forward mounting location of an AK-type rifles dust cover 192. Further, the bottom side of the rear sight block 100 includes a sleeve 120 thereon that defines an opening configured to receive the barrel 192 of an AK-type rifle therein (see, e.g., FIG. 3). The rear sight block 100 also includes an opening 118 therethrough (see, e.g., FIG. 1) into which a dowel pin is press-fit to thereby secure the rear sight block 100 to the barrel 192, a well known prior art method of installing a rear sight block onto the barrel of an AK-type rifle. In addition to these functions, implementations of the rear sight block 100 provide an optic mounting interface 110 having an integrated nonadjustable (i.e., fixed) rear sight notch 102 therein, and at least one accessory mounting interface 108 thereon (see, e.g., FIG. 1). In some implementations, the optic mounting interface 110 may be used to secure an optical gun sight (e.g., a reflex sight and/or a telescopic sight) thereon (see, e.g., FIG. 5). In some implementations, the accessory mounting interface may be used to secure a firearm accessory (e.g., a flashlight, laser, and/or a secondary optic) thereon (see, e.g., FIG. 6).

Figure 7:
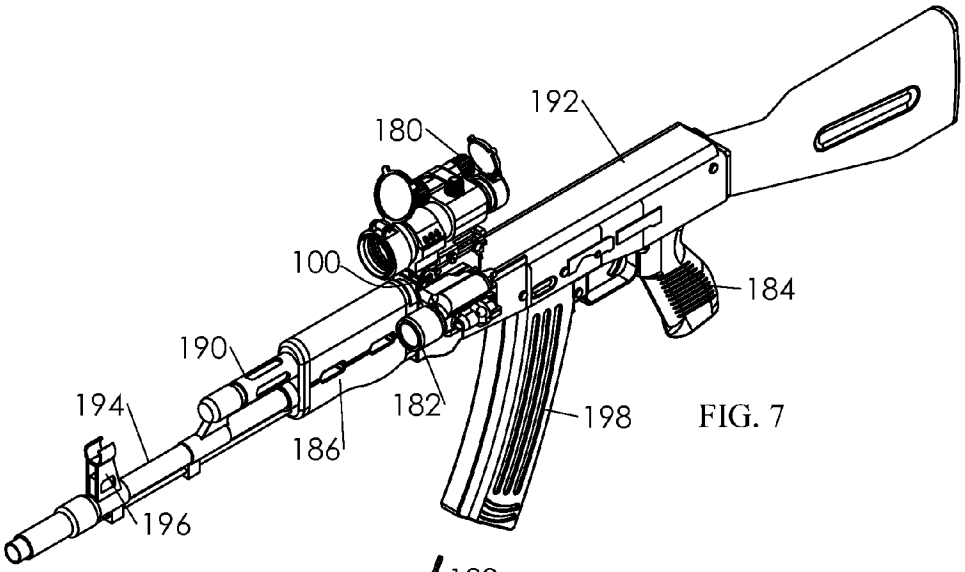
FIG. 7 illustrates an isometric view of an AK-type rifle having the rear sight block of FIG. 5 mounted thereon.

As shown in FIG. 7, in some implementations, the rear sight block 100 may be precisely positioned on the barrel 194 of an AK-type rifle so that the rear sight notch 102 is aligned with the front sight post found in the front sight tower 196 of an AK-type rifle. The precise alignment of the rear sight notch 102 with the front sight post ensures that the front sight post can be adjusted sufficiently to make the point of aim provided by the iron sights (the combination of the rear sight notch 102 and the front sight post) coincide with the point of impact of a projectile fired from the rifle.

Figure 2:
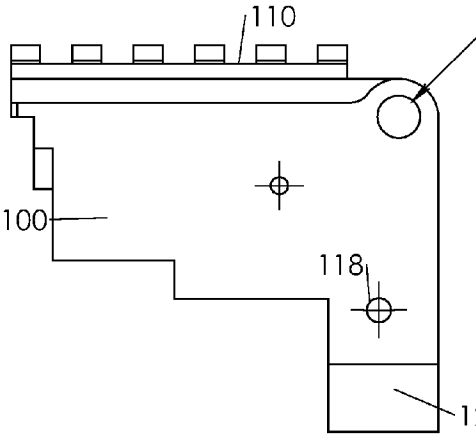
FIG. 2 illustrates a right side view of the rear sight block shown in FIG. 1.

As shown in FIG. 2, in some implementations, the cam lock hole 104 is in the same location as the cam lock hole found on prior art rear sight blocks used with AK-type rifles. In this way, a cam lock 104*a* may be used with the rear sight block 100 to secure the gas tube 190 in place on an AK-type rifle (see, e.g., FIG. 7).

Figure 8:
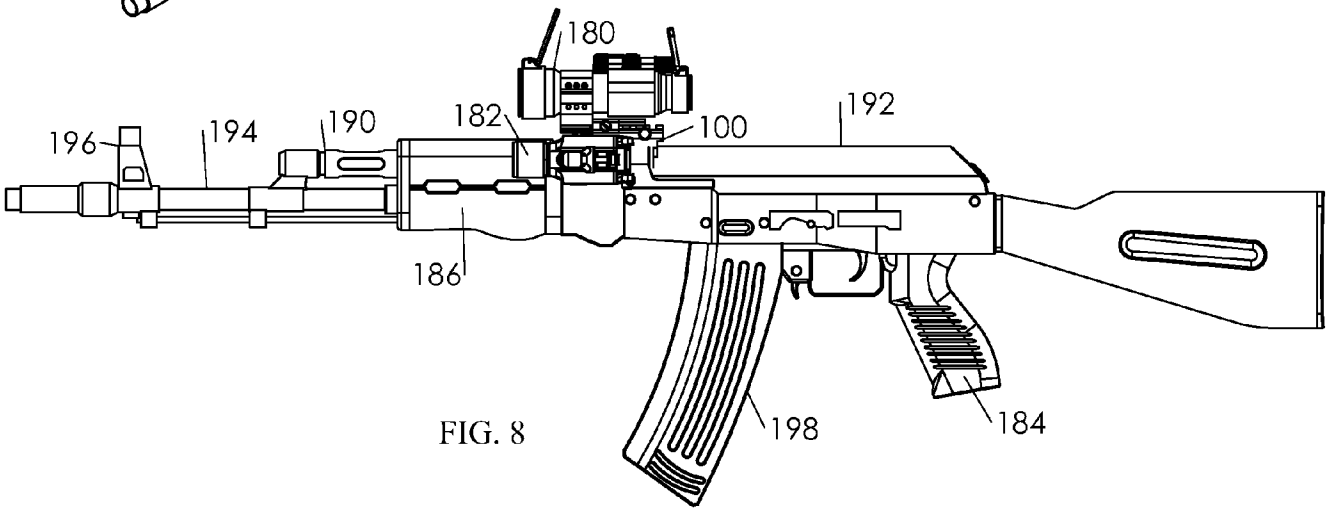
FIG. 8 illustrates a left side view of the AK-type rifle shown in FIG. 7.

As shown in FIGS. 1 and 8, in some implementations, the rear sight block 100 includes a curved slot 126 in a back side thereof configured to support the front end of the dust cover 192. The curved slot 126 is in the same location on the rear sight block 100 as it would be on prior art rear sight blocks used with AK-type rifles. In this way, the dust cover 192 may be secured to an AK-type rifle in the same or similar manner as found in the prior art.

Figure 3:
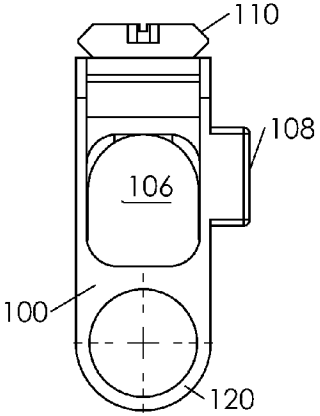
FIG. 3 illustrates a front end view of the rear sight block shown in FIG. 1.

As shown in FIGS. 1 and 3, in some implementations, the sleeve 120 located on the bottom side of the rear sight block 100 is configured to be press-fit (i.e., an interference fit which is forced together using a hydraulic press) onto the barrel 192 of an AK-type rifle (see, e.g., FIG. 7). The sleeve 120 is configured to serve the same function as the sleeve found on prior art rear sight blocks used with AK-type rifles. In this way, the rear sight block 100 may be precisely positioned and rigidly secured to the barrel 194 of an AK-type rifle. As found in the prior art, a press-fit dowel pin may be inserted through an opening 118 in the rear sight block 100 and used to secure it to the barrel 194 (see, e.g., FIGS. 1 and 7).

As shown in FIGS. 1-4, in some implementations, a rear sight block 100 for use with AK-type rifles comprises an optic mounting interface 110 having a rear sight notch 102 therein, and at least one accessory mounting interface 108. The rear sight block 100 is configured to be secured to the barrel 194 of an AK-type rifle and, as described above, perform several functions associated with prior art rear sight blocks found on AK-type rifles.

The key innovation of the rear sight block 100 disclosed herein comes from the realization that the highly adjustable rear sight (not shown) found on prior art AK-type rifles is ineffective, especially given all of its mechanical complexity. The ineffectiveness of the prior art adjustable rear sight is tied to the ammunition (7.62×39 mm and 5.45×39 mm) and thereby the bullets (i.e. projectiles) fired from AK-type rifles. The standard projectiles fired from AK-type rifles loose very little elevation due to gravity at ranges less than 300 meters, where adjustment of the rear sight is not generally needed. At ranges greater than 300 meters, both the gun and the ammunition are sufficiently inaccurate as to make elevation adjustments using the rear sight irrelevant. Implementations of the rear sight block 100 disclosed herein omit the adjustable rear sight found in the prior art and instead provide an optic mounting interface 110 having an integrated rear sight notch 102 therein (see, e.g., FIG. 1).

As shown in FIG. 1, in some implementations, the rear sight notch 102 is recessed below the top of the rails 111 of the optic mounting interface 110. In this way, the rear sight notch 102 does not interfere with the positioning of an optical gun sight 180 on the optic mounting interface 110. In some implementations, a longitudinally positioned slot 112 extends from the rear sight notch 10 through the rails 111 of the optic mounting interface 110 so that the view through the opening defined by the rear sight notch 102 is not obstructed (see, e.g., FIG. 1). In this way, the sight picture (the simultaneous alignment of target, front sight, and rear sight notch 102) is preserved. In some implementations, the bottom of the slot 112 occupies the same plane as the bottom of the transverse grooves positioned between the rails 111 of the optic mounting interface 110 (see, e.g., FIG. 1). By incorporating these features and functions into a single rear sight block 100 for use with AK-type rifles, the overall utility of the rifle is greatly increased.

As shown in FIGS. 1-4, in some implementations, the optic mounting interface 110 may be a standard accessory rail system such as a MIL-STD-1913 rail or a Weaver rail mount. In some implementations, other accessory rail systems suitable for securing an optic and/or other firearm accessory (e.g., a flashlight and/or a laser) to a firearm may be used. In some implementations, the optic mounting interface 110 may be any mounting solution suitable for securing an optic to a firearm (e.g., threaded holes and/or a quick release dovetail cam). In general, the optic mounting interface 110 provides an optic 180 secured thereon with a rugged, stable, and direct mechanical tie to the barrel 194 of the host AK-type rifle (see, e.g., FIG. 7). In this way, the optic 180 is better able to maintain zero.

Figure 4:
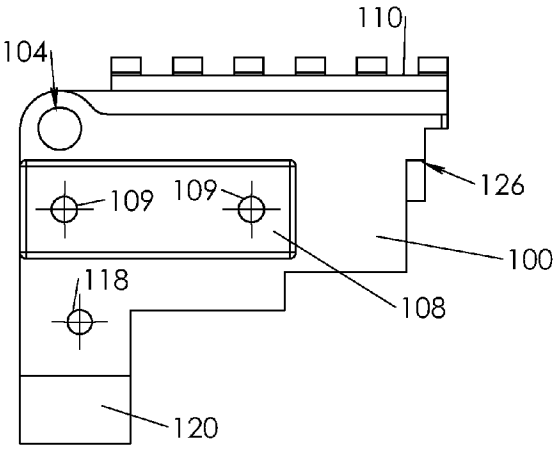
FIG. 4 illustrates a left side view of the rear sight block shown in FIG. 1.
Figure 6:
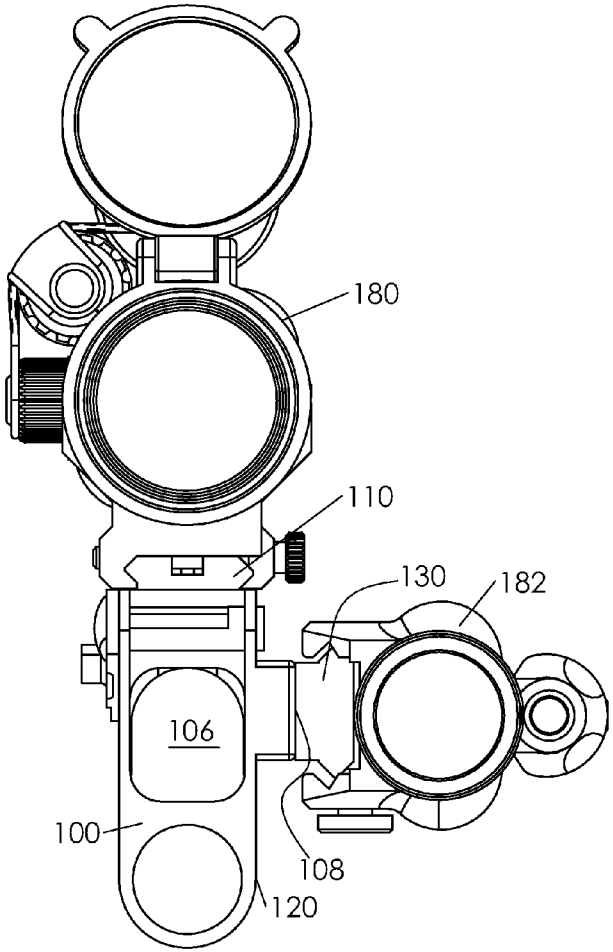
FIG. 6 illustrates a front end view of the rear sight block shown in FIG. 5.
Figure 5:
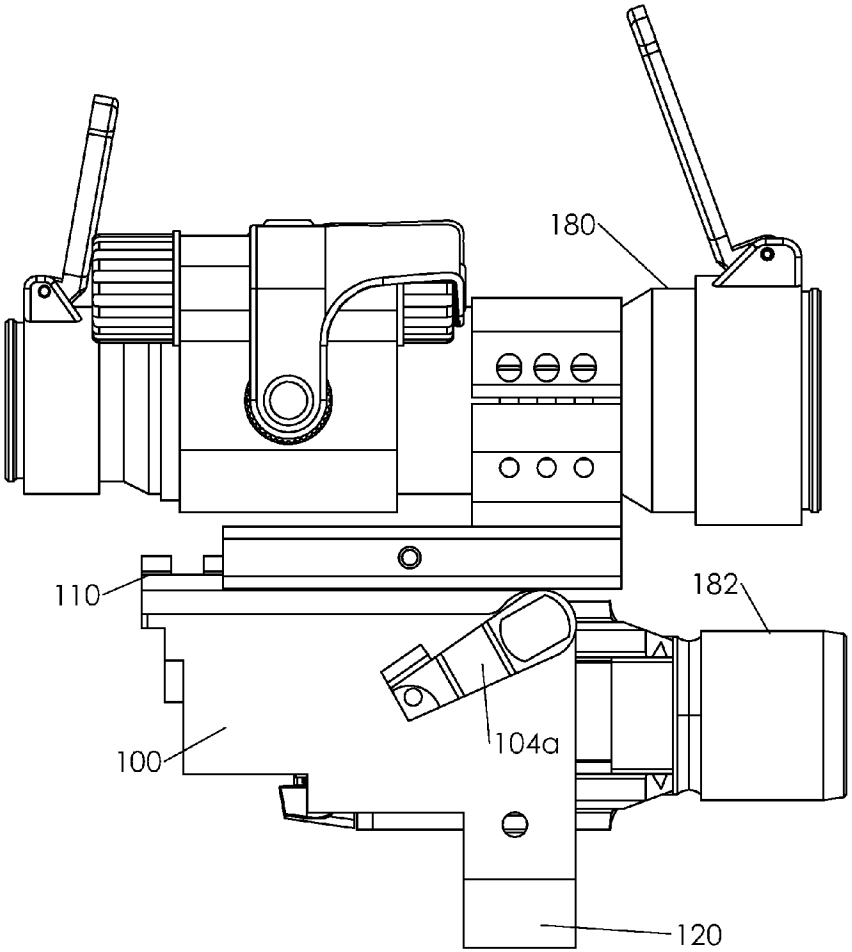
FIG. 5 illustrates a right side view of the rear sight block shown in FIGS. 1-4 with an optic (reflex sight) and a flashlight mounted thereon.

As shown in FIGS. 1, 3, and 4, in some implementations, the accessory mounting interface 108 may include two tapped mount holes 109 therein. In this way, through the use of threaded fasteners, a section of MIL-STD-1913 rail 130 (i.e., a Picatinny rail section) may be secured thereto (see, e.g., FIG. 6). In some implementations, a rail section of another suitable accessory rail system (e.g., Weaver rail mount) may be secured to the accessory mounting interface 108 through the use of threaded fasteners. In some implementations, the accessory mounting interface 108 may have the general shape of a rectangle and protrude from the left side (or, in some implementations, the right side) of the rear sight block 100 (see, e.g., FIG. 6). In some implementations, the accessory mounting interface 108 may be a MIL-STD-1913 rail or Weaver rail mount integrally machined as part of the rear sight block 100. In some implementations, the accessory mounting interface 108 may be any structure known to one of ordinary skill in the art suitable for mounting firearm accessories (e.g., a flashlight, laser, and/or infrared illuminator) thereto.

As shown in FIG. 7, in some implementations, the longitudinal axis of the accessory mounting interface 108 may run parallel to the longitudinal axis of the barrel 194. In some implementations, the longitudinal axis of the accessory mounting interface 108 may not run parallel to the longitudinal axis of the barrel 194 (not shown).

In some implementations, not shown, there may be an accessory mounting interface 108 on the right side of the rear sight block 100. In some implementations, there may be two or more accessory mounting interfaces 108 on the rear sight block 100 (e.g., one on the left side and one of the right side of the rear sight block 100).

In some implementations, an accessory mounting interface 108 could be at a non-orthogonal angle relative to the optic mounting interface 110. In some implementations, an accessory mounting interface 108 may be positioned on the rear sight block 100 at a 45 degree angle relative to the optic mounting interface 110. In this way, for example, a user may mount a telescopic sight on the optic mounting interface 110 and offset a second optic (e.g., a reflex sight) at a 45 degree angle relative to the telescopic sight.

In some implementations, the rear sight block 100 may be fabricated from forged and/or machined 4340 steel. In some implementations, the rear sight block 100 may be fabricated from any suitable steel alloy, aluminum alloy, plastic, resin, fiberglass, ceramic, other metal alloy, or other structural material known to one of ordinary skill in the art. In some implementations, the rear sight block 100 may be fabricated using one or more of the following processes: machining, forging, extruding, casting, sintering, and/or 3-D printing. In fact, early prototypes of the rear sight block 100 were successfully implemented using 3-D printed nylon parts which performed very well in field testing.

An important aspect of the rear sight block 100 disclosed herein is its impact on the ergonomics of an equipped rifle. FIGS. 7 and 8 show the rear sight block 100 installed on a fully assembled AK-type rifle. In some implementations, the rear sight block 100 is mounted at or near the rifle's approximate center of mass. In this way, weight in the form of an optic 180 and/or other firearm accessory (e.g., a flashlight and/or laser) mounted to the rear sight block 100 is unlikely to change the balance or "feel" of the rifle when handled by an operator. This is important, as a very small amount of mass placed forward of the rifles center of mass feels disproportionately heavy to the operator.

For right hand dominant operators, another advantage of the preferred implementation of the rear sight block 100 shown in FIGS. 7 and 8 is the position that the accessory mounting interface 108 places a firearm accessory (e.g., a laser equipped flashlight 182) secured thereon. Right hand dominant operators typically hold an AK-type rifle by grasping the magazine 198 or lower handguard 186 with their left hand and the rear pistol grip 184 with their right hand. In a tactical situation (e.g., response by police to an active shooter), the flashlight 182 is generally only used for brief periods of time, for example, to illuminate an operators direction of movement and/or to illuminate a potential threat prior to the application of lethal force (i.e., shooting the threat). After the immediate need for illumination has passed (e.g., after successfully engaging a threat), it is essential to extinguish the light as it may provide other potential threats with a precise indicator of the operators location. To this end, weapon mounted flashlights are often provided with an activation switch that provides a "momentary on" function. In this way, the flashlight 182 only provides illumination for as long as the switch is depressed. Inadvertently depressing the activation switch of a flashlight 182 has the potential to harm the operator's biological night vision and/or give away their position to a potential threat (e.g., an enemy combatant, active shooter, etc.). In some implementations, the left hand of a right hand dominate operator may be used to operate the activation switch of the flashlight 182 positioned on the accessory mounting interface 108 of the rear sight block 100 while at the same time maintaining a secure grip on either the magazine 198 or the lower handguard 186 of an AK-type rifle. In some implementations, the accessory mounting interface 108 is configured to position a flashlight 182 secured thereon a sufficient distance away from the lower handguard 186 and/or magazine 198 so as to prevent the operator's left hand from inadvertently making contact with the activation switch of the flashlight 182. In this way, the unintentional activation of a flashlight 182 mounted to the rear sight block 100 may be prevented.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown, or in sequential order, or that all illustrated operations be performed, to achieve desirable results.

The invention claimed is:

1. A rear sight block for a rifle, the rear sight block comprising:

an optic mounting interface on a top side of the rear sight block, the optic mounting interface is a MIL-STD-1913 rail; and a sleeve on a bottom side of the rear sight block configured to secure about a barrel of the rifle;

wherein the optic mounting interface and the sleeve of the rear sight block are portions of a single unitary piece; and wherein a front end of the rear sight block is configured to secure a gas tube in place on the rifle.

2. The rear sight block of claim 1, wherein the optic mounting interface further comprises a rear sight notch therein.

3. The rear sight block of claim 2, further comprises a longitudinally positioned slot that extends from the rear sight notch through the optic mounting interface.

4. The rear sight block of claim 2, wherein the rear sight notch is recessed below a top side of the optic mounting interface.

5. The rear sight block of claim 1, further comprising a first accessory mounting interface on a first side of the rear sight block and a first rail section configured to be removably secured to the first accessory mounting interface, wherein the first rail section is configured so that a firearm accessory can be secured thereon.

6. The rear sight block of claim 5, further comprising a second accessory mounting interface on a second side of the rear sight block and a second rail section configured to be removably secured to the second accessory mounting interface, wherein the second rail section is configured so that a firearm accessory can be secured thereon.

7. The rear sight block of claim 5, wherein the first accessory mounting interface is at a non-orthogonal angle relative to the optic mounting interface.

8. The rear sight block of claim 1, further comprising a first accessory mounting interface on a first side of the rear sight block, the first accessory mounting interface is configured so that a firearm accessory can be secured thereon.

9. The rear sight block of claim 8, further comprising a second accessory mounting interface on a second side of the rear sight block, wherein the second accessory mounting interface is configured so that a firearm accessory can be secured thereon.

10. A rear sight block for a rifle, the rear sight block comprising:

an optic mounting interface on a top side of the rear sight block, the optic mounting interface is a MIL-STD-1913 rail;

a sleeve on a bottom side of the rear sight block configured to secure about a barrel of the rifle; and a cam lock on a front end of the rear sight block, the cam lock is configured to secure a gas tube in place on the rifle;

wherein the optic mounting interface and the sleeve of the rear sight block are portions of a single unitary piece.

11. The rear sight block of claim 10, wherein the optic mounting interface further comprises a rear sight notch therein.

12. The rear sight block of claim 11, further comprises a longitudinally positioned slot that extends from the rear sight notch through the optic mounting interface.

13. The rear sight block of claim 11, wherein the rear sight notch is recessed below a top side of the optic mounting interface.

14. The rear sight block of claim 10, further comprising a first accessory mounting interface on a first side of the rear sight block and a first rail section configured to be removably secured to the first accessory mounting interface, wherein the first rail section is configured so that a firearm accessory can be secured thereon.

15. The rear sight block of claim 14, further comprising a second accessory mounting interface on a second side of the rear sight block and a second rail section configured to be removably secured to the second accessory mounting interface, wherein the second rail section is configured so that a firearm accessory can be secured thereon.

16. The rear sight block of claim 14, wherein the first accessory mounting interface is at a non-orthogonal angle relative to the optic mounting interface.

17. The rear sight block of claim 10, further comprising a first accessory mounting interface on a first side of the rear sight block, the first accessory mounting interface is configured so that a firearm accessory can be secured thereon.

18. The rear sight block of claim 17, further comprising a second accessory mounting interface on a second side of the rear sight block, wherein the second accessory mounting interface is configured so that a firearm accessory can be secured thereon.

* * * * *